US005725302A

United States Patent [19]

Sirkin

[11] Patent Number: 5,725,302

[45] Date of Patent: Mar. 10, 1998

[54] POT LIGHT MOUNTING CLIP

[76] Inventor: Howard Sirkin, 496 de l'Erabliere, Rosemere, Quebec, Canada, J7A 4M4

[21] Appl. No.: 546,643

[22] Filed: Oct. 23, 1995

[30] Foreign Application Priority Data

Oct. 20, 1995 [CA] Canada ..... 2161051

[51] Int. Cl.[6] ..... F21S 1/02

[52] U.S. Cl. ..... 362/365; 362/148; 248/27.3; 248/343

[58] Field of Search ..... 248/342, 343, 248/27.1, 27.3; 362/147, 148, 364, 365, 366, 368, 370, 396

[56] References Cited

U.S. PATENT DOCUMENTS

| | | | |
|---|---|---|---|
| 2,800,698 | 7/1957 | Wood | 248/27.3 |
| 3,012,135 | 12/1961 | Kurtzon | 362/365 |
| 3,268,189 | 8/1966 | Ducharme | 248/343 |
| 3,279,729 | 10/1966 | Buttriss | 248/27.3 |
| 3,315,924 | 4/1967 | Greenwood | 248/642 |
| 3,316,399 | 4/1967 | Totten | 362/366 |
| 3,697,742 | 10/1972 | Bobrick | 362/366 |
| 4,293,895 | 10/1981 | Kristofek | 362/147 |
| 4,419,717 | 12/1983 | Price et al. | 362/148 |
| 4,488,206 | 12/1984 | Mizusawa | 248/27.3 |
| 4,733,339 | 3/1988 | Kelsall | 362/366 |
| 4,739,460 | 4/1988 | Kelsall | 362/365 |
| 5,068,772 | 11/1991 | Shapiro et al. | 362/365 |
| 5,314,148 | 5/1994 | Jones | 248/27.3 |
| 5,377,088 | 12/1994 | Lecluze | 362/366 |

*Primary Examiner*—Alan Cariaso
*Attorney, Agent, or Firm*—Swabey Ogilvy Renault

[57] ABSTRACT

A mounting clip for securing a recessed light fixture in a ceiling, aluminum soffite, wall and the like comprises a spring loaded resilient U-shaped element having opposed lower ends, an inner supporting flange and an outer lip portion with a secondary flange being provided slightly above the supporting flange and with a resilient projecting arm extending above the secondary flange. The supporting flange is adapted to be disposed just below the ceiling and adjacent to an opening defined therein to receive the fixture. The U-shaped spring element extends upwardly through the ceiling opening and then outwardly away from the ceiling opening such that the lip portion thereof can overlie the upper surface of the ceiling. The fixture is inserted through the ceiling opening and between the resilient projecting arms of three mounting clips distributed along the ceiling opening such that the side wall of the light fixture properly positions the mounting clips on the ceiling while the resilient arms exert forces towards the light fixture to maintain the same in position in the ceiling. A flange of the fixture disposed just below the ceiling covers the clip's supporting flange. The resiliency of the spring element allows the clip to be used with various thicknesses of gypsum board and even with aluminum soffites irrespective of the fixture's diameter. The secondary flange extends into the gypsum board or just above the aluminum soffite.

20 Claims, 2 Drawing Sheets

POT LIGHT MOUNTING CLIP

BACKGROUND OF THE INVENTION

1. Field of the Invention

The present invention relates to recessed light fixtures otherwise known as pot lights, and more particularly, to a mounting clip for retaining a light canister in a ceiling, wall or the like.

2. Description of the Prior Art

U.S. Pat. No. 5,377,088 issued on Dec. 27, 1994 to Lecluze discloses a light fixture for mounting to a ceiling which comprises a pot 10 having a peripheral outer flange 16 abutting the area adjacent to an opening defined in the ceiling. A hook 30 and a bolt 40 extending through openings 28 and 22 and 24 defined in the inner wall 12 and in the side wall 10 of the pot 10 cooperate to secure the pot to the ceiling 18, wherein the bolt 40 secures the hook 30 to the pot 10 with the outer flange 16 of the hook 30 engaging the ceiling.

U.S. Pat. No. 5,314,148 issued on May 24, 1994 to Jones discloses a housing 20 for mounting electrical fixtures in a recessed fashion into walls on ceilings 38 with the housing 20 including a surface flange 40 and two sets of three axially directed slots 30a, 30b, and 30c in the side wall such that the housing flange 40 is flush with the wall or the ceiling 38. A pair of spring elements 32 are compressed and inserted through the appropriate slots 30a, 30b and 30c which allow the springs 32 to bear against the slots 30a, 30b, and 30c and interior surface 44 of the ceiling 38 or wall for holding the flange flush thereon.

U.S. Pat. No. 4,733,339 issued on Mar. 22, 1988 to Kelsall discloses a clip for retaining a light canister 98 of a light fixture 100 in a hole 90 defined in a ceiling 88 with the clip 10 including a bendable leg member 12 which can be positioned between first and second positions thereof. In the first position, the canister 98 is insertable into the hole 90 and, in the second position, the bendable leg member 12 is moved away from the canister 98 so as to retain the canister within the ceiling 88. The clip 10 is attached to the canister 98 with holes 94 and 96. A brace member 16 extends between the bendable leg member 12 and the canister 98 to retain the leg member 12 in its second position.

U.S. Pat. No. 4,739,460 issued on Apr. 19, 1988 to Kelsall discloses a spring clip for recessed light fixtures having a cylindrical housing 10 defining a pair of opposed and aligned elongated slots 16. A pair of spring clips 14 are disposed in the slots 16 and inside the housing 10 prior to installation. The spring clips 14 can then be rotated outwardly, once the recessed light fixture has been introduced in a hole defined in the ceiling, for securing the housing 10 above the ceiling 12 in an installed position. The spring clips 14 when installed include a bent area which bears against the upper sub-ceiling surface 22 and also extend through the slot 16 of the housing 10 and then inwardly within the housing 10.

U.S. Pat. No. 3,012,135 issued on Dec. 5, 1961 to Kurtzon discloses a further spring clip 46 which is adapted to engage the inner wall of a recessed light fixture's side wall 13 and which is further adapted to have its arm 49 extend outwardly and engage a finished lower surface 40 of the plaster ceiling.

U.S. Pat. No. 4,293,895 issued on Oct. 6, 1981 to Kristofek discloses a mounting plate 14 to which are secured clips 62 which engage slotted apertures 29 defined in the housing 10 of a recessed light fixture with the mounting plate 14 being adapted to be supported by the ceiling 12.

SUMMARY OF THE INVENTION

It is therefore an aim of the present invention to provide an improved mounting assembly for removably installing a recessed light fixture to a ceiling, wall or the like.

It is also an aim of the present invention to provide a mounting clip for removably securing a recessed light fixture to a ceiling, wall or the like, irrespective of the diameter of the fixture.

It is a further aim of the present invention to provide an improved mounting clip which can universally be used to secure recessed light fixtures to gypsum board ceilings or walls or to aluminum soffites, i.e. to structures of different thicknesses.

It is a still further aim of the present invention to provide an improved spring mounting clip which is easy to install and which is completely hidden when installed and also which can be used without having to provide openings in the wall of the housing of the light fixture.

Therefore, in accordance with the present invention, there is provided a mounting clip for securing a recessed lighting fixture to a ceiling structure having upper and lower surfaces and defining a hole therethrough, the fixture having a side wall being receivable in the hole, comprising surface engaging means and fixture engaging means, said clip being at least partly resilient, said clip being adapted to be disposed outwardly of the side wall of the fixture and to engage the ceiling structure substantially at the hole thereof and to extend outwardly of the fixture and through the hole from the outer surface upwardly past the inner surface, said surface engaging means being adapted in an installed position of the fixture in the ceiling structure to bear against the upper surface of the ceiling structure outwardly of the hole while said fixture retaining means grasps the fixture by exerting a force substantially inwardly towards the fixture, whereby in said installed position the fixture and said clip interact with the ceiling structure in a secure assembly.

Also in accordance with the present invention, there is provided a recessed lighting system comprising a lighting fixture having a side wall arranged for insertion in a hole defined in a ceiling and for mounting thereto, a plurality of clips spaced around the periphery of said fixture for mounting said fixture to the ceiling, each said clip having surface engaging means and fixture engaging means, said clip being adapted to be disposed outwardly of the side wall of the fixture and to engage the ceiling substantially at the hole thereof and to extend outwardly of the fixture and substantially vertically through the hole from a lower surface of the ceiling upwardly past an upper surface thereof, said surface engaging means being adapted in an installed position of the fixture in the ceiling to interact with the upper surface of the ceiling outwardly of the hole while said fixture retaining means interacts with the fixture by exerting an inwardly directed force thereon, whereby in said installed position the fixture and said clips interact with the ceiling structure in a secure assembly.

Further in accordance with the present invention, there is provided a mounting clip for securing a recessed lighting fixture to a ceiling defining a hole therethrough, the fixture having a side wall insertable in the hole, comprising at opposed ends thereof first and second engaging means adapted to interact respectively with an upper surface of the ceiling and with a lower surface of the ceiling outwardly of the hole thereof, wherein in an installed position of the fixture in the ceiling said clip is disposed outwardly of the side wall of the fixture and interacts with the ceiling at said opposed ends thereof with said clip extending through the hole outwardly of the side wall of the fixture, said clip further comprising fixture retaining means adapted to interact with the side wall of the fixture by exerting an inwardly directed force thereon such that in said installed position the fixture and said clip interact with the ceiling in a secure assembly.

BRIEF DESCRIPTION OF THE DRAWINGS

Having thus generally described the nature of the invention, reference will now be made to the accompanying drawings, showing by way of illustration a preferred embodiment thereof, and in which.

DESCRIPTION OF THE PREFERRED EMBODIMENTS

Figure 1:
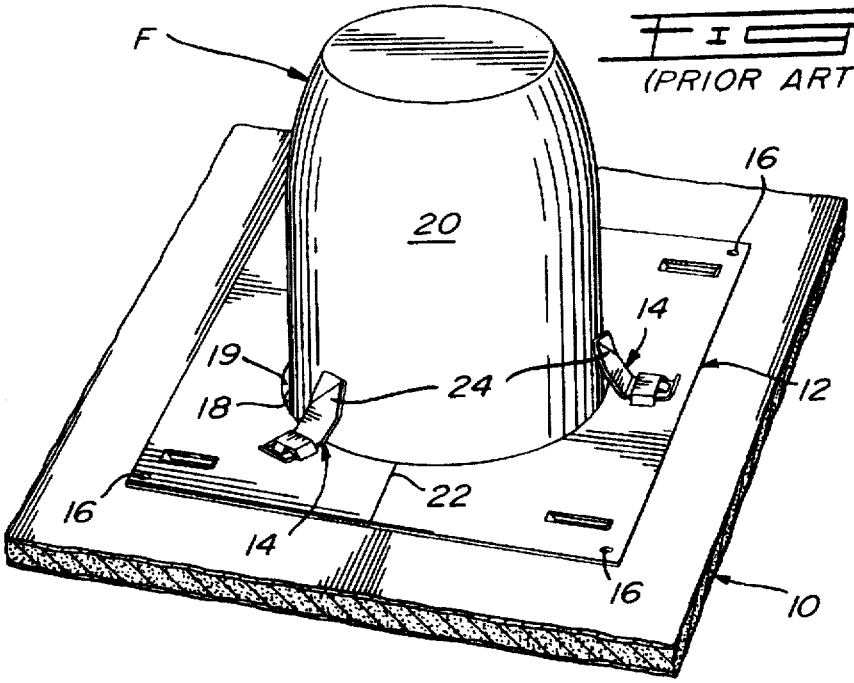
FIG. 1 (PRIOR ART)
FIG. 1 is a perspective view of a recessed light fixture mounted above a ceiling by way of conventional mounting plate and associated clips.

FIG. 1 illustrates how a recessed light fixture F is conventionally secured within a ceiling 10 using a conventional mounting plate 12 and three conventional spring clips 14. More particularly, in a new construction, the mounting plate 12 is secured to the ceiling's wood joists by way of nails inserted upwardly through apertures 16 defined at the corners of the mounting plate 12. After the ceiling 10 and, more particularly, the gypsum board thereof has been secured to the joists, the recessed light fixture F can be twistingly and upwardly introduced through a suitable opening defined in the ceiling 10 such that light fixture F slides through an opening 18 defined in the mounting plate 12 with the spring clips 14 carried by the mounting plate 12 frictionally engaging a side wall 20 of the light fixture F in such a manner that the light fixture F becomes secured in position within the opening defined in the ceiling 10 and the space provided thereabove.

In an existing construction, once the opening has been defined in the ceiling's gypsum board, the mounting plate 12 is torn at fold line 22 and then the transverse dimensions of the mounting plate 12 can be reduced to permit the insertion of the mounting plate 12 through the gypsum board's opening and thus thereabove the ceiling 10. In such a case, the mounting plate 12 is not nailed to the joists but is held by four tabs which are folded outwardly under the lower surface of the ceiling. More particularly, an annular flange 19 extends downwards from the mounting plate 12 at its opening 18 (as partly seen in FIG. 1). The four tabs which are distributed along the flange 19 extend downwards from a lower edge of the flange 19 such that, when the mounting plate 12 is in position above the ceiling 10, the tabs can be outwardly folded so as to extend horizontally below the ceiling 10 for substantially loosely retaining the mounting plate 12 thereto. The recessed light fixture F can then be introduced in the ceiling's opening and between the three spring clips 14 although this installation is somewhat more difficult in view of the relative displaceability of the mounting plate 12 above the ceiling 10.

With the above conventional mounting assembly which includes the mounting plate 12 and the spring clips 14, various mounting plates 12 defining different sized central openings 18 are required in order to accommodate the various diameters that can be encountered at the level of the side wall 20 of the light fixture F. It is noted that the three clips 14 include inclined resilient arms 24 having a spring force generally directed toward the longitudinal axis of the opening 18 of the mounting plate 12 to ensure that the light fixture F is secured therebetween.

Figure 2:
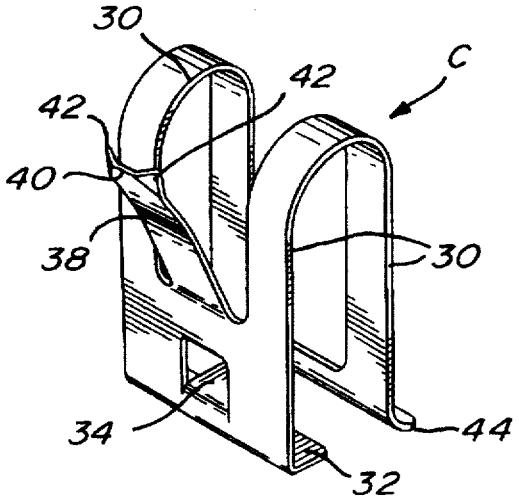
FIG. 2 is a perspective view of a mounting clip for recessed light fixtures in accordance with the present invention.

In accordance with the present invention, FIG. 2 illustrates a mounting clip C which can be used to secure the recessed light fixture F to the ceiling 10 without requiring any mounting plates such as the mounting plate 12 of FIG. 1 and without requiring that the light fixture F defines clip receiving openings in its side wall 20 as it is the case with most of the clips of the prior art described hereinbefore. Now referring to FIG. 4, it is seen that the light fixture F comprises at a lower end of its side wall 20 an outwardly extending flange 26 which covers and hides the edges of an opening 28 defined in the ceiling as well as an adjacent annular portion extending outwardly thereof. As the mounting clip C of the present invention can be used without any mounting plates, the same clip C can conveniently be used for mounting light fixtures F of various diameters.

Figure 4:
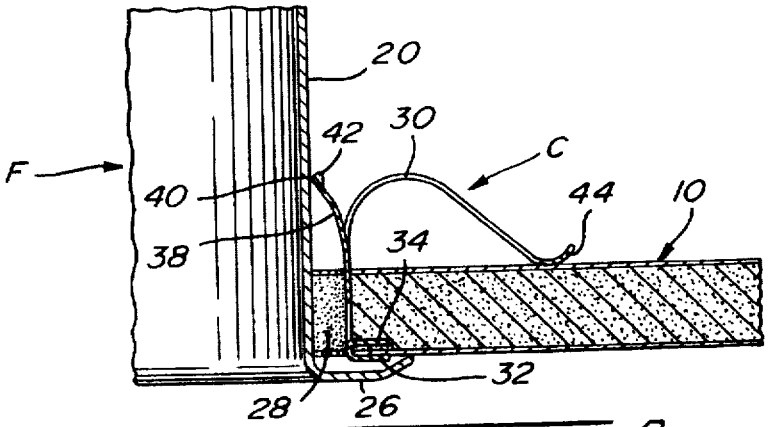
FIG. 4 is a cross-sectional side view based on the assembly of FIG. 3 and showing how one mounting clip of the present invention retains the recessed light fixture secured to a ceiling.
Figure 5:
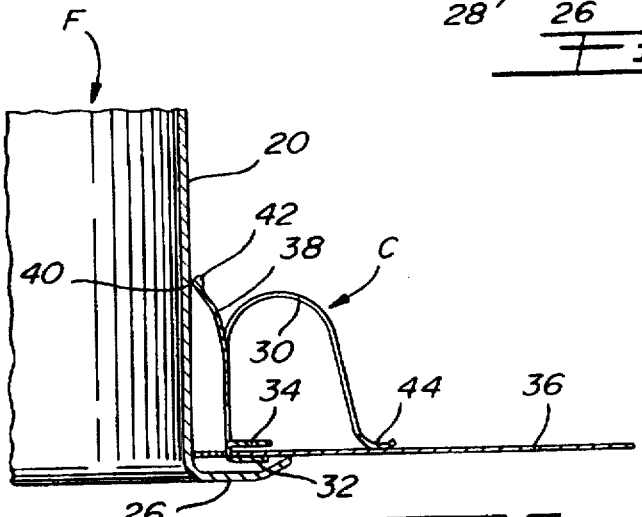
FIG. 5 is a cross-sectional side view similar to FIG. 4 but showing how the mounting clip can be used to secure the recessed light fixture to a thinner structure, e.g. an aluminum or plastic soffite.

Again referring to FIG. 2, the mounting clip C is made of a spring-loaded steel and includes a spring element 30 in the form of a deformably resilient inverted U. The mounting clip C further includes a supporting flange 32 at an inner lower end of the spring element 30 and adapted to be positioned below the ceiling 10 (see FIG. 4); a secondary flange 34 parallel to the supporting flange 32 and slightly spaced thereabove and adapted to either penetrate the gypsum board of the ceiling 10 (see FIG. 4) or to overlie an aluminum or plastic soffite sheet 36 (see FIG. 5) with the soffite sheet 36 thus extending between the supporting flange 32 and the secondary flange 34. The mounting clip C further comprises a forwardly projecting arm 38 which, in position, is directed inwardly towards a longitudinal axis of the fixture F or of the ceiling opening 28. The projecting arm 38 comprises a free end defining a central square edge 40 adapted to bite into the exterior surface of the side wall 20 of the light fixture F and a pair of beveled side edges 42 which allow the recessed light fixture F to be removed from the ceiling 10 or from the soffite 36 using a twisting movement and without being damaged by the mounting clips C. A terminal lip portion 44 is provided at an outer lower end of the spring element 30, i.e. at an end opposite the supporting flange 32, that is at the outward end of the clip C when installed as in FIG. 3, the lip portion 44 being adapted to overlie the gypsum board 10 or the soffite sheet 36 as seen respectively in FIGS. 4 and 5. The spring force provided by the U-shaped spring element 30 of the mounting clip causes the clip C to be secured to the gypsum board at its supporting flange 32 and terminal lip portion 44, as seen in FIG. 4 for an assembly to the ceiling 10 and in FIG. 5 for an assembly to the aluminum soffite 36. In fact, this spring force urges the lip portion 44 downward against the upper surface of the ceiling 10 (or soffite 36) while urging the supporting flange 32 upward against the lower surface of the ceiling 10 (or soffite 36), adjacent to the ceiling opening 28 while the projecting arms 38 exert radially directed inward force on the fixture F thereby forming a secure overall assembly constituted of the clips C, the fixture F and the ceiling 10 (or soffite 36).

In cases where the fixture F is mounted to a wall, the lip portion 44 and the supporting flange 32 will obviously bear respectively against inner and outer surfaces of the wall.

Figure 3:
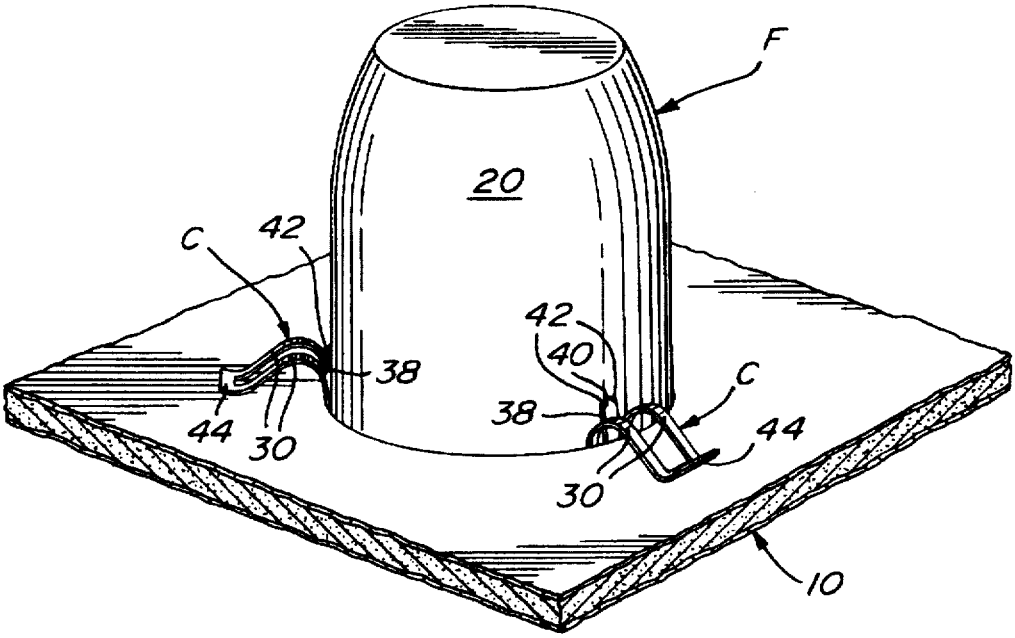
FIG. 3 is a perspective view of a recessed light fixture mounted to a ceiling by way of three clips of the present invention, such as that illustrated in FIG. 2.

In an assembled state, three mounting clips C are used with the clips C being equally spaced and distributed around the light fixture F as seen in FIG. 3 where two mounting clips C are shown with the third mounting clip being hidden behind the light fixture F. To install the light fixture F to the ceiling 10 or to the aluminum soffite sheet 36 by way of the mounting clips C, the mounting clips C are first loosely positioned onto the ceiling 10 or soffite sheet 36, the clips C being loosely supported at their lip portions 44 and secondary flanges 34 with the secondary flanges 34, in the case of an assembly to a gypsum board 10, being forceably inserted in the friable plaster material, as seen in FIG. 4. The light fixture F is then carefully introduced through the opening 28 with the side wall 20 of the fixture F engaging the resilient projecting arms 38 of the mounting clips until the light fixture F has been fully introduced in the ceiling 10 or the aluminum soffite sheet 36, that is until the flange 26 of the fixture F abuts the undersurface of the ceiling 10 or of the aluminum soffite sheet 36, as seen respectively in FIGS. 4 and 5. In an assembled position, the side wall 20 of the light fixture F forces the mounting clips C outwardly and thus in position with the projecting arms 38 of the clips C exerting an inner force radially towards a longitudinal axis of the light fixture F, whereby the mounting clips C interact with both the ceiling 10/soffite sheet 36 and the light fixture F in a secure assembly. The flange 26 of the light fixture F besides hiding the edge of the opening 28 defined in the ceiling 10/soffite sheet 36 also hides the supporting flanges 32 of the mounting clips C, as well seen in FIGS. 4 and 5.

In view of the flexibility and resiliency of the U-shaped spring element 30 of the present clip C, the mounting clip C can accommodate panels having various thicknesses (from a 1/16th of an inch aluminum soffite 36 to a ¾ inch thick gypsum board panel). Furthermore, as stated hereinabove, the present mounting clips C can be used with light fixtures F and ceiling openings 28 having various diameters. Also, the installation of a light fixture F in a new ceiling or in an existing ceiling is identical with the present mounting clips C as opposed to the different installation steps which must be followed for prior art assemblies, such as the mounting plate 12 and spring clips 14 of FIG. 1. Furthermore, the assembly of the light fixture F with the ceiling 10/aluminum soffite 36 is as solid in an existing ceiling as it is in a new construction ceiling, as opposed to the mounting plate 12 of FIG. 1 which, in a new construction, is nailed to the inner wood structure of the ceiling, while being in an existing ceiling somewhat loosely retained to the ceiling 10 by the four above described tabs.

We claim:

1. A mounting clip for securing a recessed lighting fixture to a panel structure having inner and outer surfaces and defining a hole therethrough, the fixture having a side wall being receivable in the hole, comprising panel engaging means and resilient fixture retaining means, said clip being adapted to be disposed completely outwardly of the side wall of the fixture and to engage the panel structure substantially at the hole thereof with said panel engaging means extending, outwardly of the fixture, through the hole from the outer surface inwardly past the inner surface such as to contact the panel structure at the hole and thus be substantially incapable of movement away from the fixture, said panel engaging means being adapted in an installed position of the fixture in the panel structure to bear against the panel structure while said fixture retaining means which extends inwardly from said panel engaging means grasps an outer surface of the side wall of the fixture, whereby in said installed position the fixture and said clip interact with the panel structure in a secure assembly.

2. A mounting clip as defined in claim 1, wherein said clip comprises a resilient member of substantially inverted U-shape, said panel engaging means including surface engaging means provided at an outer lower end of said resilient member for resiliently bearing against the inner surface of the panel structure, flange means being provided at an inner lower end of said resilient member and extending substantially towards said outer lower end for engaging the outer surface of the panel structure, said fixture retaining means extending from an inner portion of said resilient member and above the inner surface of the panel structure towards the side wall of the fixture and into frictional engagement therewith, whereby a resiliency of said resilient member secures said clip at said surface engaging means and said flange means to the panel structure, substantially irrespective of a thickness of the panel structure.

3. A mounting clip as defined in claim 2, wherein said fixture retaining means comprises a resilient arm extending inwardly and forwardly from said inner portion of said resilient member and towards the fixture such as to exert an inward radial force on the fixture.

4. A mounting clip as defined in claim 3, wherein said resilient arm defines at an upper free end thereof a transversally oriented central square edge adapted to grasp the side wall of the fixture and a pair of beveled edges, one on each side of said square edge, for facilitating at least a removal of the fixture from the panel structure.

5. A mounting clip as defined in claim 2, wherein a secondary flange is provided at said inner portion and above said flange means for extending horizontally into the panel structure outwardly from the hole thereof and between the inner and outer surfaces of the panel structure where the panel structure includes a gypsum board, or for extending horizontally above the panel structure and outwardly of the hole where the panel structure includes a soffite.

6. A mounting clip as defined in claim 2, wherein said surface engaging means comprises a lip portion integral with said outer lower end of said resilient member and adapted to overlie the inner surface of the panel structure, said lip portion being curved to allow for a sliding displacement of convex surface thereof along the inner surface of the panel structure during installation of said clip and of the fixture.

7. A mounting clip as defined in claim 2, wherein at least two mounting clips are used to secure the fixture to the panel structure, said mounting clips being distributed substantially uniformly along the hole.

8. A mounting clip as defined in claim 7, wherein three mounting clips are distributed at substantially 120° angles along the hole to secure the fixture to the panel structure.

9. A mounting clip as defined in claim 2, wherein an outwardly directed peripheral flange provided at a lower exposed end of the fixture covers said flange means of said clip in said installed position.

10. A recessed lighting system comprising a lighting fixture having a side wall arranged for insertion in a hole defined in a panel and for mounting thereto, a plurality of clips spaced around the periphery of said fixture for mounting said fixture to the panel, each said clip having panel engaging means and resilient fixture retaining means, said clip being adapted to be disposed completely outwardly of the side wall of the fixture and to engage the panel substantially at the hole thereof with said panel engaging means extending, outwardly of the fixture, through the hole from an outer surface of the panel inwardly past an inner surface thereof such as to contact the panel structure at the hole and thus be substantially incapable of movement away from the fixture, said panel engaging means being adapted in an installed position of the fixture in the panel to interact with the panel while said fixture retaining means which extends inwardly from said panel engaging means interacts with an outer surface of the side wall of the fixture by exerting an inward force thereon, whereby in said installed position the fixture and said clips interact with the panel in a secure assembly.

11. A mounting clip for securing a recessed lighting fixture to a panel defining a hole therethrough, the fixture having a side wall insertable in the hole, comprising first and second engaging means adapted to interact respectively with an inner surface of the panel and with an outer surface of the panel outwardly of the hole thereof, wherein in an installed position of the fixture in the panel said clip is disposed completely outwardly of the side wall of the fixture and resiliently interacts with the panel at said first and second engaging means with said clip extending through the hole outwardly of the side wall of the fixture and contacting the panel structure at the hole and thus being substantially incapable of movement away from the fixture, said clip further comprising fixture retaining means extending inwardly from said first and second engaging means and adapted to frictionally engage an outer surface of the side wall of the fixture such that in said installed position the fixture and said clip interact with the panel in a secure assembly.

12. A mounting clip as defined in claim 11, wherein said first and second engaging means are comprised in an at least partly resilient U-shaped member, said first engaging means bearing against the inner surface with said second engaging means bearing against the outer surface.

13. A mounting clip as defined in claim 12, wherein said first engaging means is resiliently displaceable and said second engaging means comprises flange means extending outwardly of the hole and underlying the outer surface, said fixture retaining means being resilient and extending from an inner portion of said U-shaped member and above the inner surface towards the side wall of the fixture and into frictional engagement therewith, whereby a resiliency of said U-shaped member secures said clip at said first and second engaging means to the panel structure, substantially irrespective of a thickness of the panel structure, whereas a resiliency of said fixture retaining means causes said clip to retain the fixture in position within the hole of the panel structure.

14. A method for mounting a recessed lighting fixture having a side wall, in a hole defined in a panel having inner and outer surfaces, comprising the steps of positioning at least one mounting clip to the panel such that said mounting clip is retained in position at said hole by the panel, said mounting clip having a resilient fixture engaging means; introducing the fixture into the hole defined in the panel from said outer surface thereof towards said inner surface thereof with an exterior surface of the side wall of the fixture engaging said resilient engaging means of said mounting clip, wherein as said mounting clip is prevented by the panel from displacing away from the fixture, said mounting clip can exert an inward force on the fixture to secure the fixture to the panel.

15. A mounting clip for securing a recessed lighting fixture in a hole defined in a panel, the fixture having a side wall and an outwardly extending flange at a lower end thereof, the panel having inner and outer surfaces, said mounting clip comprising first and second surface engaging means and resilient fixture retaining means, said first surface engaging means being spring loaded with respect to said second surface engaging means, wherein said first and second surface engaging means are adapted to respectively bear against the inner and outer surfaces of the panel, said fixture retaining means extending from said first and second surface engaging means towards the center of the hole and being adapted for frictional engagement with the side wall of the lighting fixture such that the fixture is secured into the hole to the panel.

16. A mounting clip as defined in claim 15, wherein said clip comprises a resilient member of substantially inverted U-shape, said first and second surface engaging means being provided at opposed ends of said resilient member, said fixture retaining means extending from said resilient member and above the inner surface of the panel towards the side wall of the fixture and into frictional engagement therewith, whereby a resiliency of said resilient member secures said clip at said first and second surface engaging means to the panel for various thicknesses of panels.

17. A mounting clip as defined in claim 16, wherein said fixture retaining means comprises a resilient arm extending inwardly and forwardly from an inner portion of said resilient member and towards the fixture such as to exert an inward radial force on the fixture, said resilient arm defining at an upper free end thereof a transversally oriented central square edge adapted to grasp the side wall of the fixture and a pair of beveled edges, one on each side of said square edge, for facilitating at least a removal of the fixture from the panel.

18. A mounting clip as defined in claim 15, wherein a flange is provided inwardly of said second surface engaging means for extending horizontally into the panel outwardly from the hole thereof and between the inner and outer surfaces of the panel where the panel includes a gypsum board, or for extending horizontally above the panel and outwardly of the hole where the panel includes a soffite.

19. A mounting clip as defined in claim 16, wherein said first surface engaging means comprises a lip portion integral with said resilient member and adapted to overlie the inner surface of the panel, said lip portion being curved to allow for a sliding displacement of a convex surface thereof along the inner surface of the panel during installation of said clip and of the fixture.

20. A mounting clip as defined in claim 16, wherein said resilient member comprises flange means at said second surface engaging means, said flange means extending substantially towards said first surface engaging means for engaging the outer surface of the panel, said flange means of said clip being covered by an outwardly directed peripheral flange provided at a lower exposed end of the fixture in an installed position thereof.

* * * * *